United States Patent [19]

Aoki

[11] Patent Number: 4,483,022

[45] Date of Patent: Nov. 20, 1984

[54] BASEBALL GLOVE

[75] Inventor: Katsumi Aoki, Ikeda, Japan

[73] Assignee: Mizuno Corporation, Osaka, Japan

[21] Appl. No.: 388,189

[22] Filed: Jun. 14, 1982

[51] Int. Cl.[3] ..... A41D 13/10
[52] U.S. Cl. ..... 2/19
[58] Field of Search ..... 2/19; 69/2, 21

[56] References Cited

U.S. PATENT DOCUMENTS

Re. 28,036 6/1974 Rosenbaum ..... 2/19
4,339,830 7/1982 Sasaki ..... 2/19

*Primary Examiner*—Louis K. Rimrodt
*Attorney, Agent, or Firm*—Fleit, Jacobson, Cohn & Price

[57] ABSTRACT

Meshwork patterns are impressed upon the whole or a portion of a back leather member of a baseball glove to stiffen the leather and mesh-like apertures are formed in the stiffened leather to provide it with air-permeability.

2 Claims, 4 Drawing Figures

BASEBALL GLOVE

This invention relates to baseball or softball padded coverings, such as gloves, catcher's mitts or first baseman's mitts, used in catching balls.

Although the invention is disclosed hereinafter in connection with a baseball glove, the term "glove" should be broadly interpreted to include catcher's and first baseman's mitts.

Such a baseball glove generally comprises a padded palm body including a face and an inside member or relatively soft natural or artifical leather, and a back member of the same material which, with the inside member, defines finger sheathes. Felt pads in the palm body are arranged to form a pocket in the area over the palm and held in position to prevent the glove from losing its shape. As the glove is repeatedly used over a long period, the glove members tend to stretch to such an extent that the face and inside members become separated from the felt pads to result in the glove's losing its shape. Moreover, because of poor air-permeability of the leather, the inside member of the padded body gets wet with sweat from the hand in contact therewith to such an extent that the sweat can permeate into the inside member. Repeated wetting and drying will result in a change in the quality and a reduction in the durability of the leather.

The main object of the present invention is to provide a baseball glove which can eliminate the above-mentioned disadvantages.

Another object of the invention is to provide a baseball glove wherein a back leather member thereof is processed to provide it with air-permeability and enough stiffness to reduce stretch of the back leather member.

According to the invention, there is provided a baseball glove comprising a padded palm body including a face and an inside leather member, and a back-leather member which, with the inside leather member, defines finger sheathes wherein the back leather member has at least a portion of its whole area stiffened by impressing meshwork patterns thereupon and a number of mesh-like apertures formed in the whole or a portions of the stiffened area.

Other objects and advantages of the invention will become apparent from the following description of embodiments thereof taken with reference to the accompanying drawings, in which.

Figure 1:
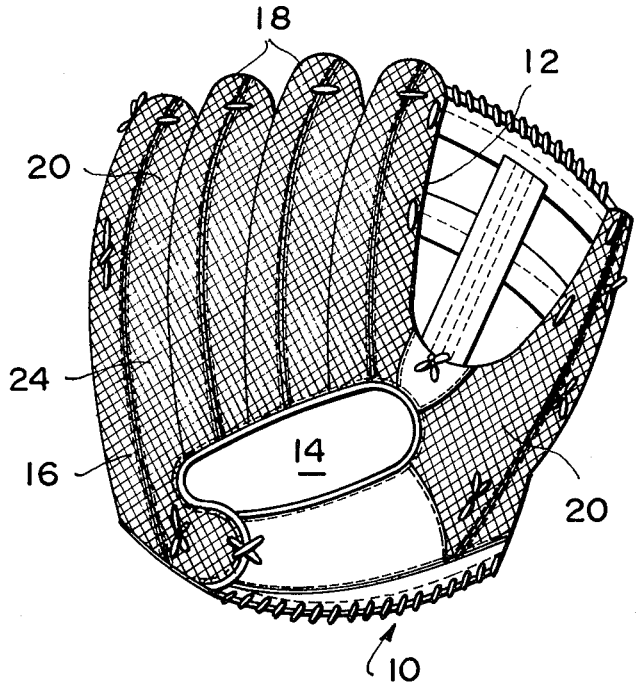
FIG. 1 is a back perspective view of a baseball glove constructed in accordance with the invention.
Figure 2:
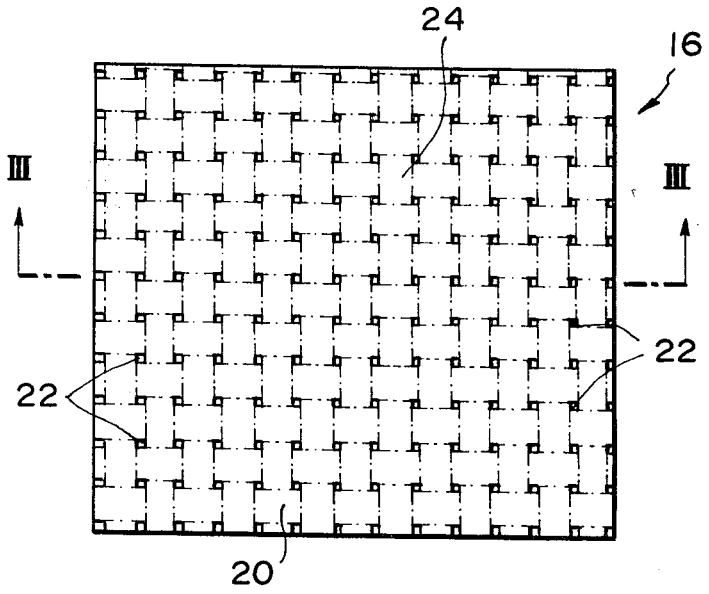
FIG. 2 is an enlarged plan view of a portion of a back leather member of the glove.

Referring to FIG. 1 of the drawings, there is shown a baseball glove 10 comprising a padded palm body 12 including a face leather member (not shown) and an inside leather member 14, and a back leather member 16 which, with the inside leather member 14, defines finger sheathes 18. Meshwork patterns 20 are impressed upon the back leather member 16 to stiffen it over the whole area. The impressed meshwork patterns are made to simulate a plain weave pattern wherein a series of bands appear to be positioned perpendicular to each other and appear to weave under and over each other. As can be best seen in FIGS. 2 and 3, the back leather number 16 is provided with a member of mesh-like apertures 22 formed in the whole or a portion of the stiffened area 24 thereof. In case where the back leather member 16 is lined with a thinner leather, apertures may be formed in the thinner leather lining (not shown).

Figure 4:
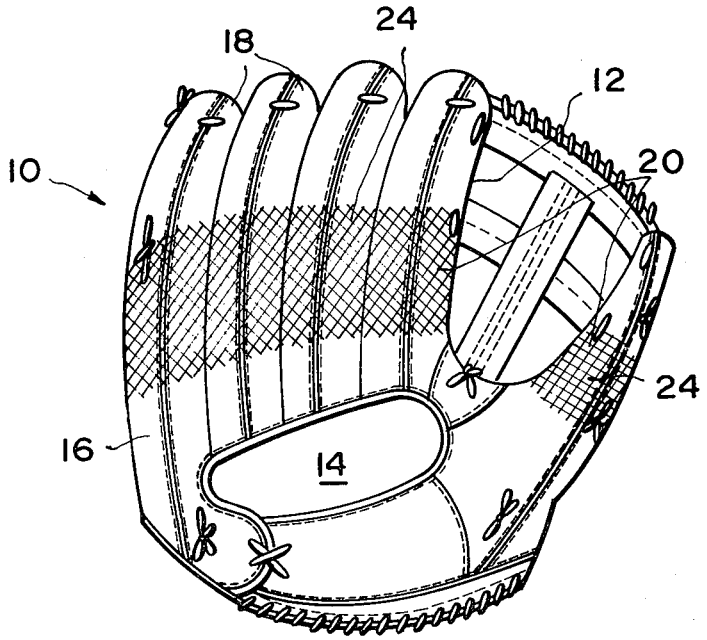
FIG. 4 is a similar view to FIG. 1 showing a modification of the glove according to the invention.

In FIG. 4 of the drawings, there is shown a baseball glove 10 similar to that shown in FIG. 1 except that portions 24 of the back leather member 16 are stiffened by impressing meshwork patterns 20 thereupon. It will be understood that similarly, the stiffened portions 24 of the back leather member 16 have a number of mesh-like apertures 22 formed therein.

Figure 3:
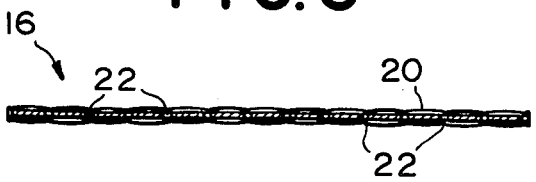
FIG. 3 is a cross-sectional view of the back leather member taken along line 3—3 of FIG. 2.

It will be anticipated that the impressions of the meshwork patterns upon the leather result in a reduction in stretch of the leather. The meshwork pattern 10 is impressed onto back leather member 16. As shown in FIG. 3, back leather member 16 has been impressed to form a series of impressions along the surface of member 16. The impressed areas of pattern 20 serve to stretch the member 16 across the raised areas of pattern 20. The stretched, raised areas, stiffens the member 16 to form a more rigid member than would be present without the pattern 20 impressed on the surface of member 16.

Thus, the stiffened back leather member 16 having the reduced stretch restricts a stretch of the face and the inside leather member during use of the glove 10 so that the shape of the glove 10 can be maintained over a long period. It is important that the back leather member of the glove is liable to be bent in catching balls with the glove. The apertures 22 formed in the whole or a portion of the stiffened area of the back leather member serve to facilitate its bending. The apertures 22 also serve to provide the back leather member with air-permeability.

Passages of air through the apertures 22 in the back leather member 16 result in a minimization in an amount of sweat coming out on the hand which wears the glove. Because of no change in the quality of the leather, the durability of the glove is increased over the prior art.

What I claim:

1. An improved baseball glove, said glove comprising:

a padded palm body including a face and an inside leather member and a back leather member, said back leather member with said inside leather member define finger sheaths wherein the improvement comprising at least a portion of the back leather member is stiffened by impressing said back leather member into a simulated woven meshwork pattern including an overlapping series of band areas, wherein the impressing serves to stretch the band areas and a number of mesh-like apertures are formed in the spaces defined between the overlapping band areas of the meshwork pattern in said stiffened portion of said back leather member.

2. A glove as claimed in claim 1, wherein said number of mesh-like apertures are formed in the whole of said stiffened portion of said back leather member.

* * * * *